United States Patent [19]

Barker

[11] Patent Number: 4,907,408

[45] Date of Patent: Mar. 13, 1990

[54] VARIABLE DISPLACEMENT HYDRAULIC SERVOMOTOR SYSTEM

[75] Inventor: Brian P. Barker, Chandler, Ariz.

[73] Assignee: Allied-Signal Inc., Morris Township, Morris County, N.J.

[21] Appl. No.: 185,002

[22] Filed: Apr. 22, 1988

[51] Int. Cl.[4] ..... F16D 31/02

[52] U.S. Cl. ..... 60/451; 60/452; 60/487; 60/489; 60/493; 60/494

[58] Field of Search ..... 60/493, 450, 451, 452, 60/445, 487–490, 494

[56] References Cited

U.S. PATENT DOCUMENTS 3,890,064 6/1975 Boehringer et al. .
4,168,652 9/1979 Bick .
4,195,479 4/1980 Dezelan ..... 60/445 X
4,286,927 9/1981 Boehringer .
4,712,377 12/1987 Yoshida et al. ..... 60/493 X
4,768,340 9/1988 Hamilton ..... 60/493 X

FOREIGN PATENT DOCUMENTS 563530 6/1977 U.S.S.R. ..... 60/452

*Primary Examiner*—Edward K. Look
*Attorney, Agent, or Firm*—Terry L. Miller; James W. McFarland

[57] ABSTRACT

A bidirectional hydraulic servomotor system includes a variable-displacement motor which may impel or brake movement of a load member that either resists or assits movement by the servomotor, respectively. The direction of load movement is under control of a directional control valve with motor displacement and function (impelling or braking) being effected automatically to achieve controlled load movemement with minimal consumption of hydraulic fluid.

20 Claims, 3 Drawing Sheets

VARIABLE DISPLACEMENT HYDRAULIC SERVOMOTOR SYSTEM

TECHNICAL FIELD

The present invention is in the field of hydraulic motors. More particularly, the present invention relates to a variable displacement hydraulic servomotor, a servomotor system including such a motor, and hydraulic servomotor methods.

Conventional hydraulic servomotors are known wherein a rotational cylinder defines a circumferentially arrayed plurality of axial bores each reciprocally receiving one of a like plurality of plunger members. The plunger members are driven to reciprocate in the bores as the cylinder rotates by their cooperation with a variably angulated swash plate. By variation of the angular position of the swash plate, the displacement of the hydraulic servomotor may be varied.

In the aerospace field it is conventional to effect movement of aerodynamic control surfaces by use of fixed displacement hydraulic servomotors. The displacement of these motors is selected to meet stall torque requirements under maximum aerodynamic, or peak load, conditions. During operation under less than peak loads the flow demand of the fixed displacement motor is in excess of that required by the aerodynamic load. Thus, an unnecessary burden to supply pressurized fluid volume is placed on the aircraft hydraulic system.

Heretofore, while it has been recognized that variable-displacement hydraulic servomotors offer advantages of reduced consumption of pressurized hydraulic fluid during periods of off-peak operation, their use has been ruled out by deficiencies in conventional servomotor control teachings when considered for application in the aerospace environment. In other words, the aerospace application environment requires a hydraulic servomotor and system which is substantially unaffected by the variable pressure to which an aircraft hydraulic reservoir is subject. Also, certain of the aerodynamic control surfaces of an aircraft present a uniquely challenging problem to the designer of a variable displacement hydraulic servo system. That is, the aircraft control surface, or load member for the servo system, may present a uniform resisting load, or a varying resisting load. The load may change from resisting to assisting, or vice versa, during some control movements, or under certain maneuvering conditions of aircraft flight. Under all of these varying conditions, the displacement of the servomotor must be controlled to effect movement of resisting loads at a desired rate with minimal fluid consumption. The servomotor displacement must be controlled to meet stall torque requirements of the variable resisting load without consumption of fluid volume in excess of that required to move the load. Also, assisting load conditions must not be allowed to cause runaway motion of the control surface. Under these assisting load conditions the servomotor must function as a pump to act like a brake controlling movement of the control surface. But, the braking effect must not be excessive or uncontrolled in its action. The transition from driving a resisting load to braking an assisting load must not be so slow as to allow runaway movement of the control surface, or so sudden as to result in impact-like braking.

All of the above considerations have heretofore mitigated against application of variable displacement hydraulic servomotors to effect movement of the flight control surfaces of aircraft.

DISCLOSURE OF THE INVENTION

The present invention provides a variable displacement hydraulic servomotor, a servomotor system, and servomotor method wherein the displacement control member of the motor is resiliently biased to a minimum displacement position. A pair of oppositely acting pistons are effective upon the displacement control member. The pistons are, under control of a differential pressure responsive shuttle valve and a differential pressure responsive metering valve, communicated with the motor ports so that the differential fluid pressure across the motor results in a corresponding control pressure which is effective to urge the displacement control member toward the maximum displacement position. This is true whether the motor is driving a resisting load, or being driven as a pump by an assisting load. The direction of motor operation is exclusively under control of a direction control valve. The pair of pistons are also balanced because both are exposed to the internal case pressure of the motor so that variations in case pressure do not cause a change in the displacement control function of the motor. Variations in motor case pressure may result from changes in the hydraulic system reservoir pressure as the aircraft altitude changes.

The servo system includes a flow control device effective on the return conduit from the motor to throttle the return fluid flow dependent upon the volume level flow rate of this flow. Return fluid flow from the motor is gradually throttled so long as the volume flow rate thereof is below a selected level. Upon the volume flow rate of returned fluid reaching the selected level, which is indicative of the servomotor being driven by an assisting load, the flow is throttled at a rapidly increasing function of fluid flow volume. Thus, a very effective load-braking function is effective upon the return volume of fluid reaching the selected level.

During operation of the servo system with an assisting load, the servomotor functions as a pump pressurizing the fluid return conduit which is throttled by the flow control device. The displacement control function of the servomotor remains biased toward a minimum displacement position for the displacement control member. However, in the event that sufficient braking torque is not provided by the servomotor, the displacement control function is effective to increase motor displacement, to thereby increase braking torque.

According to a particularly preferred embodiment of the invention, the servomotor is of the axial piston swash plate type having a pair of fluid flow ports. The swash plate, or displacement control member, is yieldably biased to a minimum displacement position. A first plunger member is exposed on one side to internal motor case pressure and on the other side is exposed to a higher, metered control pressure from a metering valve. The first plunger urges the swash plate toward an increased or maximum displacement position in opposition to the yieldable bias thereon. A second plunger is also effective to move the swash plate, and is exposed to internal motor case pressure and to the lower or return fluid pressure from the motor. The second plunger is arranged to assist the yieldable bias in urging the swash plate to the minimum displacement position. A differential pressure responsive spool valve provides communication of the higher or supply and of the lower or return fluid pressures to the metering valve and second plunger, respectively, as described above. The pressure differential responsive metering valve controls flow of inlet pressure fluid to the first plunger so that a pair of displacement control dead bands are created on both sides of a proportional control band. In the proportional control band motor displacement transitions progressively between minimum and maximum values. A directional control valve is provided to select motor rotational direction by supplying pressure fluid to one motor port and receiving return fluid from the other motor port. A flow control device is provided in the return fluid conduit to provide a motor-braking function during operation of the servomotor system with an assisting load.

An advantage of the present invention is the provision of a hydraulic servomotor system which during off peak-load operation consumes considerably less pressurized hydraulic fluid than would a fixed displacement servomotor having the same stall torque.

An additional advantage is the provision of a hydraulic servomotor which during peak-load operation is able to provide a stall torque favorably comparable to that of a fixed displacement servomotor.

Another advantage of this invention is the provision of a hydraulic servo system wherein load movement is accomplished with automatic transition between load driving and load braking by the servomotor as required to control load velocity.

Yet another advantage of the present invention is the provision of a hydraulic servomotor system wherein direction of operation of the servomotor is under the exclusive control of a simple directional control valve with displacement control and functional transition between load driving and load braking being performed automatically by the servo system.

Additional objects and advantages of the present invention will be apparent from a reading of the following detailed description of a single preferred embodiment, taken in conjunction with the appended drawing figures, in which:

BEST MODE FOR CARRYING OUT THE INVENTION

Figure 1:
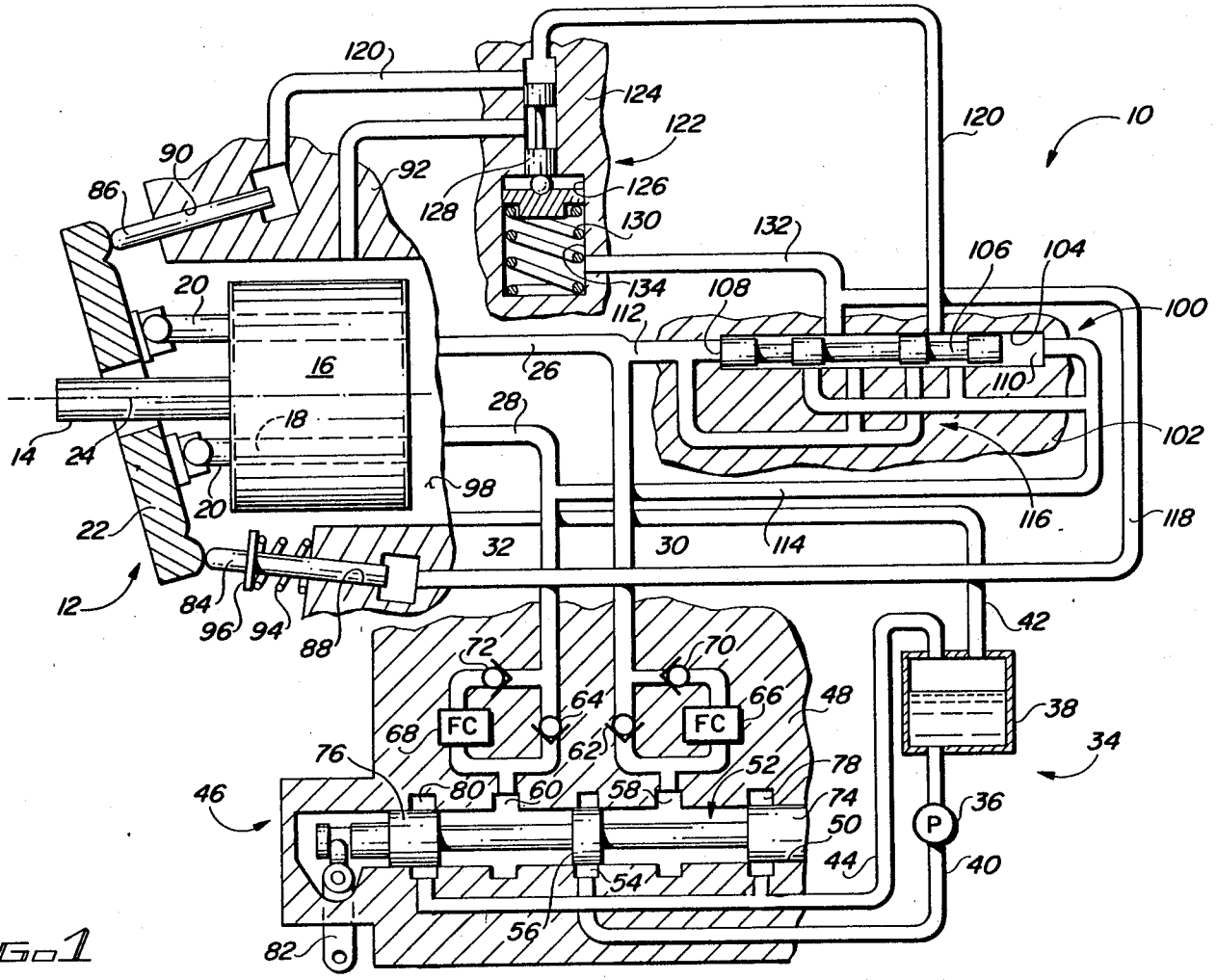
FIG. 1 schematically depicts a servo system embodying the present invention, and having component parts thereof shown partially in cross section or in symbolic form for ease of understanding.

FIG. 1 depicts schematically a variable displacement hydraulic servomotor system (10) embodying the present invention. The system (10) includes a variable displacement bidirectional hydraulic motor (12) which is of the swash plate type. The motor (12) includes a rotary shaft (14) by which the motor's output and braking torque may be connected to a movable load member (not shown). It is important to understand that the load member to which the shaft (14) is connected may either resist or assist movement thereof by the hydraulic servomotor system (10). Carried upon the shaft (14) and drivingly connected thereto is a cylinder member (16). The cylinder member (16) defines a plurality of circumferentially arrayed and axially extending bores (18) (not visible viewing FIG. 1). A plurality of plunger members (20) are sealingly and reciprocally received in the plurality of bores (18) of the cylinder member (16). The plunger members (20) extend from the cylinder member (16) to movably engage a variably angularly disposed swash plate member (22). As a result of the angular disposition of the swash plate member (22), the plunger members are driven to reciprocate in the bores (18) in response to rotation of the shaft (14) and cylinder member (16). The swash plate member (22) is pivotally carried by the motor (12) for movement about a pivot axis generally referenced with the numeral (24). It will be appreciated that by pivotally readjusting the angular position of the swash plate member (22) the length of reciprocation of the plurality of plunger members (20) with rotation of the cylinder member (16) and the displacement of the motor (10) is selectively variable.

Further it will be understood that the plurality of bores (18) at their end opposite the swash plate member (22) open to a conventional fluid flow commutation device (not shown) such that fluid flow to and from the plurality of bores (18) in a pair of conduits (26) and (28) is unidirectional in each conduit and is dependent upon the direction of rotation of shaft (14) and cylinder (16). The conduits (26) and (28) open in ports (30) and (32) respectively on the pump (12).

In order to provide fluid flow to the motor (12) and to receive return fluid therefrom, the servo system (10) includes a source (34) having a pump (36) receiving fluid from a reservoir (38) and delivering this fluid pressurized via a conduit (40). The source (34) is also able to receive returned fluid, as by conduits (42) and (44) opening into the reservoir (38). The reservoir (38) is maintained at a relatively small positive pressure with respect to ambient. This reservoir pressure is considerably below the system pressure provided by pump (36).

The servo system (10) also includes a directional control valve generally referenced with the numeral (46). The control valve (46) includes a housing (48) defining a bore (50) wherein is slidably and sealingly received a spool valve member (52). The conduit (40) communicates with an annular chamber (54) circumscribing the spool valve (52) at a central land (56) thereof. Spaced from the annular chamber (54) and land (56) on opposite sides thereof are a pair of annular chambers (58) and (60) respectively communicating with the ports (30) and (32) and conduits (26) and (28) via a respective pair of check valves (62) and (64) and a pair of flow control devices (66) and (68). Each of the flow control devices (66) and (68) also includes a respective check valve (70) and (72). Further spaced apart from the center land (56), the flow control valve (52) includes a pair of end lands (74) and (76) respectively aligning with a pair of annular chambers (78) and (80). Each of the annular chambers (78) and (80) communicates with the return conduit (44) opening into the reservoir (38).

In order to provide pressurized fluid from the source (34) via the conduit (40) to either one of the conduits (26) and (28) of the motor (12) the spool valve (52) of the directional control valve (46) is movable either rightwardly or leftwardly from the centered position illustrated via a lever (82). By way of example, if the spool valve (52) is moved rightwardly from its centered position as depicted, the conduit (40) is communicated with the conduit (28) via chambers (54) and (60) and the check valve (64). Consequently, fluid returned from the motor (12) via conduit (26) must flow past the check valve (70) and through the flow control device (66) on its way to chamber (58). As a result of the land (74) also being moved rightwardly, the chamber (58) is communicated with chamber (78), and fluid may flow therefrom to the return conduit (44) and thence to reservoir (38).

It will be seen that the motor (12) also includes a pair of oppositely acting plunger members (84) and (86) which are sealingly and reciprocally received in respective bores (88) and (90) defined by the housing (92) of the motor (12). A coil compression spring (94) extends between the housing of the pump (12) and a spring stop (96) carried upon the plunger (84) in order to yieldably bias the swash plate member (22) toward a minimum displacement position. Each of the plungers (84) and (86) is fluid pressure responsive by its exposure at its rightward end to a respective chamber wherein is receivable fluid pressure and by its exposure at its left end within a cavity (98) within the motor (12). The conduit (42) communicates cavity (98) to the reservoir (38).

The servomotor system (10) also includes a bistable valve device generally referenced with the numeral (100). The valve device (100) includes a housing (102) defining an elongate bore (104) therein. Slidably and sealingly received within the bore (104) is an elongate spool valve member (106). The spool valve cooperates with the housing (102) to define a pair of variable volume chambers (108) and (110) at opposite end of the spool valve member. A branch passage (112) from conduit (26) connects with the chamber (108) while a branch passage (114) from conduit (28) connects with the chamber (110). Thus it will be appreciated that the spool valve member (106) is movable between either one of two possible positions at opposite ends of the bore (104) depending upon the sense of fluid pressure differential existing between the conduits (26) and (28) of the motor (12). By way of example, the spool valve member (106) is depicted at its leftward position wherein the conduit (26) has a lower fluid pressure than the conduit (28). Consequently, the flow path means generally referenced with the numeral (116) communicates the conduit (26) via passage (112) with a conduit (118) communicating with the plunger member (84). On the other hand, the higher pressure conduit (28) is communicated via passage (114) and the flow path (116) of the bistable valve (100) with a passage (120) leading to a differential pressure responsive metering valve (122) and subsequently to the plunger (86) of the motor member (12). If the sense of pressure differential between conduits (26) and (28) is reversed, the valve member (106) will shift rightwardly so that the lower pressure is still communicated to plunger (84), while the higher pressure is communicated to metering valve (122) and plunger (86).

Interposed in the passage (120) between the bistable valve (100) and the plunger (86) of motor (12), the metering valve (122) includes a housing (124) defining a stepped bore (126) therein in which is received a stepped valve member (128). A spring (130) urges the valve member (128) to a first position wherein communication between the upstream portion of passage (120) leading from the bistable valve (100) and the downstream portion of passage (120) leading to the plunger member (86) is closed. The differential pressure responsive metering valve (122) also has connection with the passage (118) via a passage (132) so that the larger diameter portion (134) of the stepped bore (126) is communicated with the lower of the fluid pressures existing at the conduits (26) and (28).

Having observed the structure of servo system (10) in overview, attention may now be given to its operation. During operation of the servo system (10) the pump (36) draws fluid from the reservoir (38) and provides this fluid pressurized to the conduit (40). The direction of operation of the servomotor (12) is selectable by movement of lever (82) to shift the spool valve (52) either rightwardly or leftwardly from its centered position as depicted in FIG. 1. By way of example, the spool valve (52) may be shifted rightwardly from its centered position as depicted so that the conduit (40) is communicated with the port (32) and conduit (28) of servomotor (12) to supply pressure fluid thereby to the bores (18) within cylinder member (16). This supply of pressure fluid will result in rotation of cylinder member (16) and shaft (14) in a selected direction of rotation and in the return of relatively lower pressure fluid via the conduit (26) to the directional control valve (46). The returned flow of fluid will pass through check valve (70) and flow control device (66) on its way to the reservoir (38) via conduit (44).

If the servomotor (12) is driving a resisting load, the supplied fluid from pump (36) and conduit (28) will have a higher pressure than the returned fluid in conduit (26). That is, a differential pressure will exist across the servomotor (12). Consequently, the shuttle valve (100) will be in its leftward position as depicted in FIG. 1. It will be seen that in the position depicted of the shuttle valve (100), the conduit (26) is communicated with the passage (118) and the plunger member (84). Consequently, the relatively lower return fluid pressure acting upon plunger member (84) assists the spring (94) in biasing the swash plate member (22) to the lower displacement position thereof.

So long as the resisting torque required to drive the load member is below a certain value, the pressure differential between conduits (26) and (28) will remain below a selected level. However, in the event the resisting torque exceeds the certain value, the pressure differential across the servomotor (12) as appearing at conduits (26) and (28) will reach and perhaps exceed the certain value. This fluid pressure differential across the servomotor (12) is also applied to the differential pressure responsive metering valve (122) by its connection in the passage (120) and connection of the larger diameter bore portion (134) with the conduit (118) via the branch passage (132). Consequently, when the differential pressure across the servomotor (12) reaches the certain value, the stepped valve member (128) of the differential pressure responsive metering valve (122) is urged downwardly to open communication through the passage (120) to the plunger member (86).

Communication of the relatively higher fluid pressure to the plunger member (86) causes this plunger to drive the swash plate member toward a position of greater angulation with respect to the shaft (14) and cylinder (16) to thereby increase the displacement per rotation of the servomotor (12). This angular repositioning of the swash plate member (22) takes place in opposition to the bias provided by spring (86) and the urging provided by plunger member (84) in response to the relatively lower fluid pressure communicated thereto.

The increased displacement of the servomotor (12) causes it to generate an increased driving torque for delivery to the load. The displacement of the servomotor (12) is progressively increased as described above in response to increasing differential pressure thereacross until a maximum displacement position is reached for the swash plate member (22).

On the other hand, in the event that the load connected with shaft (14) becomes an assisting load, this assisting load will drive the servomotor (12) as a pump and result in the fluid pressure level at the return conduit (26) reaching and then exceeding the fluid pressure level supplied to the conduit (28) by the source (34). As a reminder to the reader that the servomotor (12) may function also as a pump, it will be hereinafter occasionally referred to as a motor pump unit. As a result, the fluid flowing in conduit (26) through the motor pump unit (12) and back to the source (34) via conduit (26) will be impelled in this circulation now by both pump (36) and the motor pump unit (12) operating as a pump. The result is a larger flow of fluid than would result with the motor pump unit (12) operating as a motor. This increase in fluid flow volume is sensed by the flow control device (66). In the event that the fluid flow through device (66) reaches a determined level, this device provides a sharply increased throttling of the fluid flow which is progressive with increasing fluid flow rate.

Figure 4:
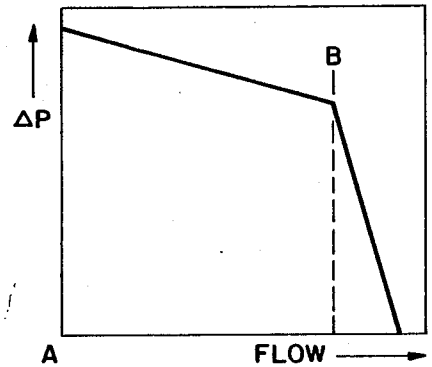
FIG. 4 presents a graphical representation of a flow-versus-pressure-drop characteristic of a component of the servo system depicted in FIG. 1.

Attention given now to FIG. 4 will graphically illustrate this progressive throttling of the return fluid flow by flow control device (66). FIG. 4 illustrates that as flow rate increases from zero at the left of the margin (line A) of the graphical depiction in FIG. 4 there is a gradually increasing inherent throttling of the return fluid flow. This inherent throttling of return fluid flow is the result of natural pipe line friction with increasing fluid flow volume and velocity. Upon the achievement of a flow rate, which is represented at line B of the graphical depiction of FIG. 4, a flow dependent throttling function begins to take effect so that as flow rate increases the pressure drop which is permitted to take place across the motor pump unit (12) decreases. In the event that the fluid flow rate continues to increase (which is indicative of an assisting load continuing to accelerate and drive the motor pump unit (12) as a pump) so that a flow rate above that indicated at line B is achieved, a sharlly increasing throttling function is provided. At flow rates at and above the level indicated by line B on the graph of FIG. 4 the pressure drop allowed across the motor pump unit (12) is greatly decreased. This throttling of the return fluid flow causes the motor pump unit (12) to act as a hydraulic brake on the load and to control the acceleration and load velocity of the assisting load.

In the event it is desired to operate the motor pump unit in the direction opposite to that described above, it is apparent that the spool valve member (52) may be shifted leftwardly in the bore (50) in response to movement of lever (82). The motor pump unit (12) will thus operate as described above but with an opposite direction of rotation and opposite direction of load movement.

Figure 2:
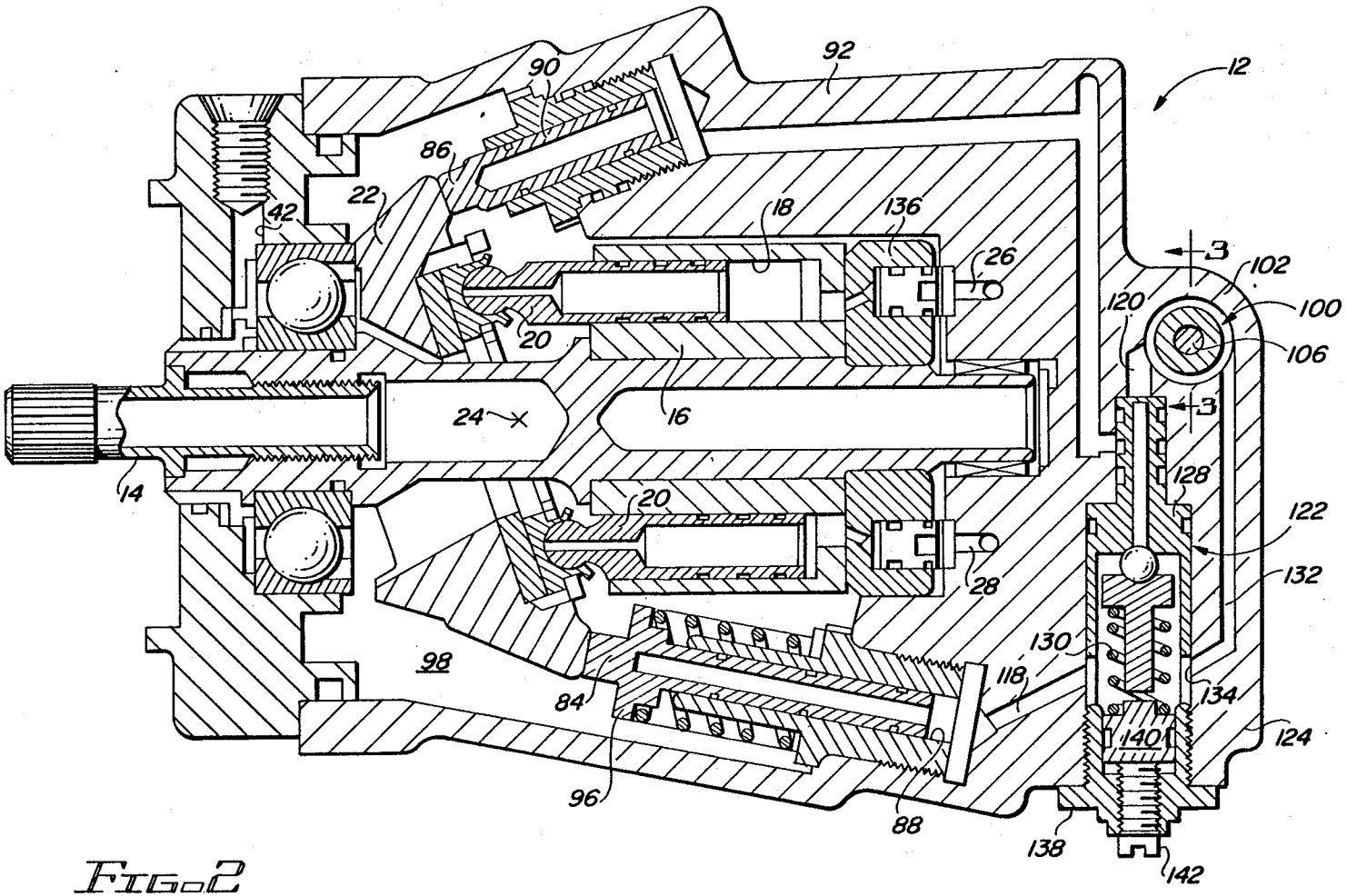
FIG. 2 provides a longitudinal cross sectional view of a servomotor portion of the servo system of FIG. 1, with parts thereof also shown schematically for ease of understanding.
Figure 3:
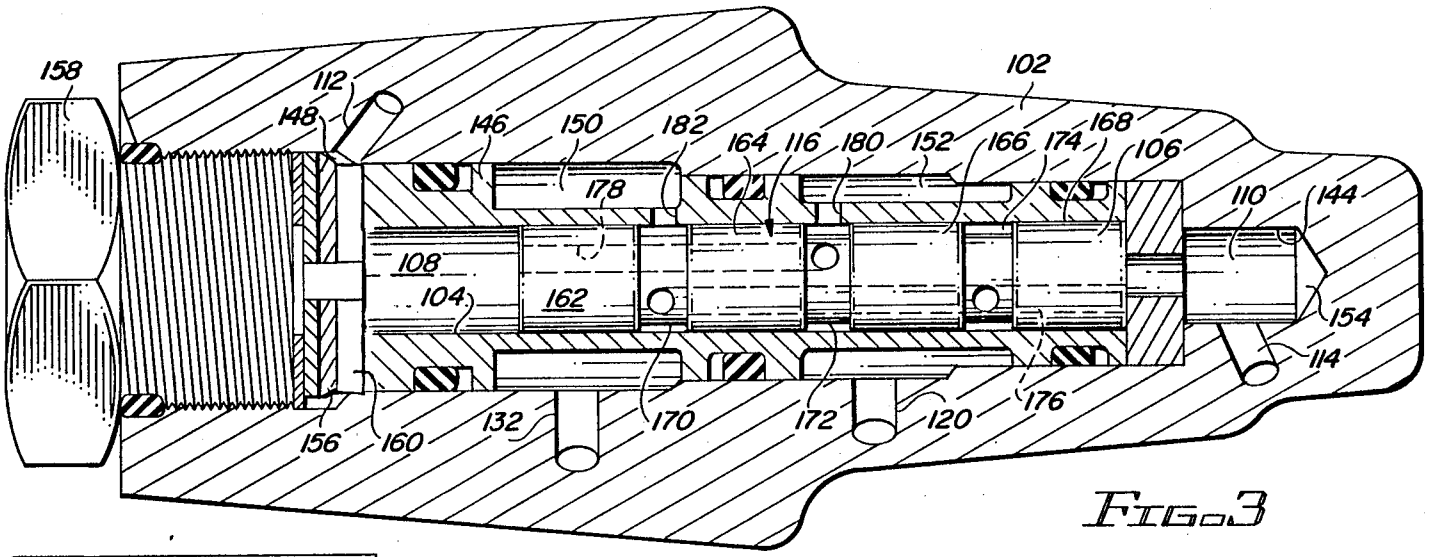
FIG. 3 provides a fragmentary cross sectional view taken along line 3—3 of FIG. 2.

Attention now to FIGS. 2 and 3 in conjunction will reveal the particular structure of the motor pump unit (12). Reference numerals used on FIG. 1 are carried over to FIGS. 2 and 3. It will be observed viewing FIGS. 2 and 3 that the housing (92) of the servomotor (12) in fact includes portions (102) and (124) thereof which receive the bistable spool valve (106) and the differential pressure responsive metering valve (122). The servomotor (12) includes a plate member (136) which is sealingly associated with the cylinder (16), and provides fluid flow communication between the bores (18) of the latter and the passages (26) and (28). Also, the motor (12) includes a plug member (138) outwardly closing the bore (134) and sealingly receiving a relatively movable spring seat (140). The spring seat (140) supports spring (130) and is adjustably movable by rotation of an adjusting member (142) threadably engaging the plug member (138). Adjustment of the preload of spring (130) by rotation of adjusting member (142) allows external adjustment of the threshold differential pressure across motor (12) whereat displacement increase is initiated. It will be recalled that this displacement increase is effected by metering of pressurized fluid to plunger (86) via the valve (122).

Viewing FIG. 3 it will also be seen that the housing (92) defines a stepped bore (144) to which the passages (112), (114), (120), and (132) open. A sleeve member (146) is sealingly received in the bore (144) and defines chambers (48), (150), (152), and (154) which are sealingly separated from one another except for their communication via sleeve member (146). The chambers (148-154) communicate with passages (112), (132), (120), and (114), respectively. Sleeve member (146) defines the bore (104) wherein is slidably received the spool valve member (106). It will be seen that a washer (156) and plug member (158) sealingly retain the sleeve member (146) and spool valve member (106) within bore (144). The washer member (156) defines radially extending slots (160) communicating the chambers (148) and (108) with one another.

The spool valve member (106) includes four axially extending land portions (162–168) which sealingly cooperate with the sleeve member (146). Between the land portions, the sleeve member defines three groove portions (170–174). The flow path (116) comprises a first passage (176) defined by the spool valve member (106) and communicating the chamber (110) with the grooves (170) and (172). The spool valve member (106) also defines a second passage (178) communicating chamber (108) with the groove (172).

In view of the above, it will be appreciated that in one of the two stable positions for spool valve member (106), as depicted, wherein the chamber (108) has the higher fluid pressure, this pressure is communicated to the passage (120) via passage (178), groove (172), and a port (180) in sleeve member (146) which opens to chamber (152). Similarly, the lower fluid pressure from chamber (110) is communicated via passage (176), groove (170) and a port (182) in sleeve member (146) to chamber (150) and passage (132).

On the other hand, should the chamber (110) have the higher fluid pressure, the spool valve member (106) is shiftable leftwardly in bore (104) to a position at the opposite end thereof. In this second position of the spool valve member chamber (110) is communicated to passage (120) via passage (176), groove (174), port (180), and chamber (152). Similarly, the chamber (108) communicates with passage (132) via passage (178), groove (172), port (182), and chamber (150).

While the present invention has been described and depicted by reference to a particularly preferred embodiment thereof, this reference does not imply a limitation upon the invention, and no such limitation is to be inferred. The invention is intended to be limited only by the spirit and scope of the appended claims, which provide additional definition of the invention.

What is claimed is:

1. Hydraulic servo apparatus comprising:

pressure fluid source means for supplying a flow of pressurized fluid and for receiving returned fluid;

bidirectional variable-displacement hydraulic motor means having a pair of fluid inlet/return ports, the function of each one of said pair of ports being dependent upon direction of motor operation;

double acting fluid pressure responsive actuator means for changing the displacement of said motor means and in response to a fluid pressure differential applied to a pair of oppositely disposed fluid pressure responsive faces thereof;

directional control means for alternatively communicating said flow of pressurized fluid to either of said pair of motor ports and for directing returned fluid from the other of said pair of ports to said fluid source means;

flow control means interposing between the other of said pair of ports and said source means for throttling said returned fluid only at and above a determined flow rate thereof, said throttling of said returned fluid increasing with fluid flow rate above said determined flow rate;

pressure responsive bistable valve means communicating with said pair of motor ports for shifting between two alternative positions to communicate the one of said motor ports having the lower fluid pressure to the one of said pair of oppositely disposed faces of said actuator means effecting a decrease of motor displacement, and communicating the one of said pair of motor ports having the higher fluid pressure to the other of said pair of oppositely disposed faces of said actuator means effecting an increase of motor displacement, and pressure differential responsive metering valve means closing said communication between said bistable valve means and said double-acting actuator means, said metering valve means being responsive to a selected pressure differential between said pair of motor ports to open said communication of said higher fluid pressure to said other pressure responsive face of said actuator means to effect a fluid pressure differential there at, and said metering valve proportionately metering said higher fluid pressure to said actuator means proportionately at pressure differentials above said selected level to increase displacement of said motor means.

2. The invention of claim 1 wherein said hydraulic motor means includes a displacement control member movable between a first position and a second position to respectively decrease and increase fluid displacement of said motor means per rotation of an output shaft thereof.

3. The invention of claim 2 wherein said double acting actuator means includes said motor means including a motor case defining an internal cavity, means communicating said internal cavity with said pressure fluid source to maintain a chosen relatively low pressure in said cavity, a pair of plunger members reciprocal in said motor case and each being exposed at one end thereof to said internal cavity and at the other end thereof defining a respective one of said pair of oppositely disposed faces, said pair of plunger means operatively associating with said displacement control member to move the latter between said first and said second positions thereof.

4. The invention of claim 1 wherein said bistable valve means includes an elongate spool valve member reciprocally received in a housing bore, means communicating said pair of motor ports respectively with opposite ends of said spool valve member, said spool valve member freely shifting between a first position at one end of said bore and a second position at the opposite end of said bore dependent upon fluid pressure differential between said pair of motor ports and defining three circumferential grooves uniformly spaced apart along the length thereof, a pair of ports opening to said bore in spaced apart relation matching the spacing of adjacent grooves on said spool valve member, each one of said pair of ports communicating with a respective one of said oppositely disposed faces of said actuator means, and said spool valve member defining a first longitudinally extending passage communicating the center one of said three grooves with one end of said spool valve member and a second longitudinally extending passage communicating the opposite end of said spool valve member with the outer two of said three grooves, whereby said center groove is in registry with a respective one of said pair of ports in each of said first and second positions of said spool valve member while one of said outer two grooves is in registry with the other of said pair of ports.

5. The invention of claim 1 wherein said pressure differential responsive metering valve means includes said hydraulic motor means including a motor case, said motor case defining a stepped bore communicating at a smaller diameter end thereof with said other motor port and at a larger diameter portion thereof communicating with said one motor port, a passage opening on said smaller diameter bore portion and communicating with said other pressure responsive face of said actuator means, and a 10 stepped valve member sealingly and reciprocally received in said smaller diameter and said larger diameter portions of 12 said stepped bore, resilient means yieldably urging said stepped valve member to a first position overlapping said passage to close communication between said other motor port and said one pressure responsive face of said actuator means, and said stepped valve member moving toward said larger diameter bore portion in response to said selected fluid pressure differential between said motor ports in opposition to said resilient means to open fluid metering communication between said other motor port and said other pressure responsive face of said actuator means.

6. Hydraulic servo system comprising:

a bidirectional variable-displacement hydraulic motor having a displacement control member movable between a first lower-displacement position and a second higher-displacement position, said motor also having a pair of fluid flow ports either of which may receive hydraulic pressure fluid while the other of said pair of ports discharges returned hydraulic fluid dependent upon the direction of rotation of said bidirectional motor;

resilient means yieldably biasing said displacement control member to said first position;

a source of pressurized hydraulic fluid, said source also including a reservoir for receiving returned hydraulic fluid at a comparatively lower pressure;

directional control valve means communicating said source with said hydraulic motor to supply said pressurized hydraulic fluid selectively to either one of said pair of ports while receiving returned fluid from the other of said pair of ports for flow to said reservoir;

flow control means interposing between said other port of said motor and said reservoir for throttling said returned fluid flow dependent upon the flow rate thereof, said flow control means substantially not throttling said returned fluid flow below a selected flow rate thereof, and providing an increasing flow-dependent throttling of said returned fluid flow at and above said selected fluid flow rate;

double-acting hydraulic actuator means having a pair of oppositely directed pressure fluid responsive faces, said hydraulic actuator means operatively connecting with said displacement control member to move the latter between said first and said second positions thereof;

pressure responsive bistable valve means communicating with said pair of fluid flow ports of said motor and moving between a first position and a second position dependent upon the sense of fluid pressure differential between said pair of motor ports, said bistable valve means communicating the one of said pair of motor ports having the lower fluid pressure with the one of said pair of oppositely directed pressure fluid responsive faces of said actuator means which is disposed to assist said resilient means in urging said displacement control member to the first position thereof, said bistable valve means further communicating the other of said pair of motor ports having the higher fluid pressure with the other of said pair of oppositely directed pressure fluid responsive faces of said actuator means;

pressure differential responsive metering valve means interposing between said bistable valve means and said other oppositely directed pressure fluid responsive face of said actuator means to respond to said higher fluid pressure, and said metering valve means also communicating with said lower fluid pressure communicating between said bistable valve means and said one pressure fluid responsive face of said actuator means, said metering valve means closing communication of said higher fluid pressure to said other face of said actuator means so long as the pressure differential between said higher pressure and said lower pressure is less than a determined value, and metering flow of said higher fluid pressure to said other pressure responsive face of said actuator proportionately to said pressure differential at and above said determined value;

said actuator means moving said displacement control member between said first position and said second position in response to flow of said higher pressure fluid to said other pressure fluid responsive face thereof in accord with the pressure balance between said pair of oppositely directed faces thereof;

whereby said servomotor may drive or brake movement of a resisting or assisting load, respectively, in either of two opposite directions under control of said directional control valve, said servomotor operating at said lower displacement so long as the fluid pressure differential thereacross is less than said determined value of said metering valve means and proportionately increasing in displacement with fluid pressure differentials above said determined value until said higher displacement is achieved, an assisting load condition operating said motor as a pump to pressurize said returned fluid above said source while said flow control means throttles said returned fluid to provide load braking at and above said selected flow rate, and said bistable valve means shifting between said first and second positions thereof to communicate said pair of motor ports with said metering valve means and said actuator means for displacement control of said motor in both directions of operation and with resisting and assisting load conditions.

7. The invention of claim 6 wherein said variable-displacement motor is of the axial piston swash plate type, said swash plate defining said displacement control member.

8. The invention of claim 6 wherein said directional control valve includes a housing defining an elongate bore therein, an elongate spool valve member reciprocally received in said bore between a first closed-center position and a pair of axially opposite motor operating positions, said spool valve member defining a center land and a pair of spaced end lands, and a pair of circumferential grooves one respectively between said center land and each of said end lands, a fluid supply port opening to said bore in registry with said center land in said closed-center position and communicating with pressure fluid from said source, and a pair of return ports opening to said bore respectively in registry with said pair of end lands in said closed-center position and communicating with said source for returning fluid thereto, a pair of ports opening to said bore each in registry with a respective one of said circumferential grooves and communicating with respective ones of said pair of motor ports, whereby said spool valve member is movable axially in either direction from said closed-center position to one of said motor operating positions to communicate pressure fluid to one of said pair of motor ports, and to communicate the other of said pair of motor ports to said source for the return of fluid thereto.

9. The invention of claim 7 wherein said double-acting hydraulic actuator means includes said hydraulic motor including a motor case defining an interval cavity housing said swash plate, said motor case defining a pair of bores opening to said cavity, a pair of functionally opposed plunger members received for reciprocation in respective ones of said pair of bores, one of said pair of plunger members communicating with said one motor port and being disposed and operatively associated with said swash plate to urge the latter toward said lower-displacement position thereof, the other of said pair of plunger members communicating with said other motor port and being disposed and operatively associated with said swash plate to urge the latter toward said higher-displacement position thereof, and said source including means maintaining said reservoir at a comparatively low pressure, and conduit means communicating said motor case cavity with said comparatively low pressure of said reservoir.

10. The invention of claim 6 wherein said pressure responsive bistable valve means includes an elongate spool valve member reciprocally received within a housing, said housing cooperating with said spool valve member to define a pair of chambers expanding and contracting in opposition at opposite ends of said spool valve member in response to reciprocation thereof, means communicating said pair of motor ports respectively with respective ones of said pair of chambers at opposite ends of said spool valve member, said spool valve member shuttling freely in response to fluid pressure in said pair of chambers between a first position and a second position wherein said spool valve member is operatively disposed at respective opposite ends of said bore, said housing and said spool valve member cooperatively defining fluid flow ports and valving surfaces cooperating in said first and second valve positions to communicate the one of said motor ports having the lower fluid pressure with said one pressure responsive face of said actuator means, and communicating the other of said pair of motor ports having the higher fluid pressure with said other pressure responsive faces of said actuator means.

11. The invention of claim 1 wherein said pressure differential responsive metering valve means includes a housing defining a stepped bore therein, said stepped bore including a smaller diameter bore portion and an adjacent larger diameter bore portion, said bore portions cooperating to define a step therebetween, a stepped plunger member movably and sealingly received in said smaller diameter bore portion and in said larger diameter bore portion, said plunger member defining a shoulder engagable with said bore step and cooperating with said stepped bore to define a pair of chambers at opposite ends of said plunger member and expanding and contracting in opposition in response to reciprocation of said plunger member, resilient means received in the larger diameter one of said pair of chambers for yieldably biasing said plunger member to a first position wherein said shoulder engages said bore step, first passage means communicating said larger diameter chamber with the one of said pair of motor ports having the lower fluid pressure, and second passage means communicating the opposite smaller diameter chamber with the other of said pair of motor ports having the higher fluid pressure to result in a fluid pressure differential across said plunger member, flow path means communicating with the other pressure responsive face of said actuator means and opening on said smaller diameter bore portion spaced from said smaller diameter chamber, said plunger member in said first position thereof sealingly preventing fluid flow from said smaller diameter chamber to said flow path means, said plunger member moving to a second position in opposition to said yieldable bias in response to said fluid pressure differential thereacross to meteringly communicate said smaller diameter chamber with said flow path means.

12. In a hydraulic servomotor system having a bidirectional rotary output drivingly connecting with a variable load which is movable in either of two opposite directions in accord with rotational direction of said rotary output, and which load may either resist or assist movement thereof by said servomotor, the method of controllably effecting movement of said load by impelling or braking movement thereof with said servomotor including the steps of:

utilizing a variable-displacement hydraulic motor having a rotary output shaft and a pair of fluid inlet/return ports as said servomotor, the inlet or return function of each one of said pair of ports being dependent upon direction of rotation of said output shaft:

drivingly coupling said output shaft with said load;

yieldably biasing said servomotor to a low-displacement condition;

providing pressure fluid flow from a source thereof to a selected one of said pair of ports and receiving returned fluid flow from the other of said pair of ports to result in rotation of said output shaft and load movement;

sensing the fluid pressure differential between said pair of ports;

upon said fluid pressure differential reaching a determined level, progressively increasing the displacement of said servomotor to a high-displacement condition as a function of said pressure differential above said determined level to provide increased impelling or braking torque to said load;

sensing the flow rate of said returned fluid flow from said servomotor; and upon said returned fluid flow rate reaching a selected level indicative upon assisting load condition, progressively throttling said returned fluid flow as a function of said returned fluid flow rate to provide increasing braking torque to said load.

13. The method of claim 12 further including the steps of utilizing said fluid pressure differential between said pair of ports to effect said increase in servomotor displacement, and providing a double acting hydraulic actuator communicating with said pair of ports and having a first pressure-responsive face urging said servomotor toward said low-displacement condition in response to fluid pressure applied thereto and a second pressure-responsive face urging said servomotor toward said high-displacement condition in response to fluid pressure applied thereon.

14. The method of claim 13 wherein said step of providing said double acting actuator includes the steps of providing a reference pressure cavity, defining each of said first and said second pressure-responsive faces on respective ones of a pair of plunger members, and exposing said pair of plunger members to said reference pressure cavity opposite the respective pressure-responsive face thereof.

15. The method of claim 13 wherein said step of utilizing said fluid pressure differential between said pair of motor ports to effect said increase in servomotor displacement includes the steps of providing a bistable pressure differential responsive value, communicating said pair of motor ports with said pressure differential responsive value to drive the latter between a first and a second position in accord with the sense of said pressure differential, communicating one of said pair of motor ports having the lower fluid pressure with said first pressure responsive face and the other of said pair of motor ports having the higher fluid pressure with said second pressure-responsive face in said first valve position, interchanging the communication of said pair of motor ports and said first and said second pressure responsive face of said actuator in said second valve position.

16. The method of claim 15 wherein said step of utilizing said fluid pressure differential between said pair of ports to effect said increase in servomotor displacement further includes the steps of interposing a differential pressure responsive normally-closed metering valve between said other of said pair of ports having the higher fluid pressure and said second pressure responsive face of said actuator, applying said fluid pressure differential of said pair of motor ports to said differential pressure responsive valve, and utilizing said differential pressure responsive valve to progressively meter pressure fluid to said second pressure responsive face as a function of said fluid pressure differential at and above a determined level of differential pressure.

17. Variable displacement hydraulic servomotor apparatus comprising:

a housing defining a cavity therein and journaling a rotatable shaft in said cavity;

a cylinder member drivingly carried upon said shaft for rotation therewith within said cavity and defining a plurality of circumferentially arrayed axially extending bores therein;

a plurality of plunger members respectively received reciprocally in said plurality of bores to cooperatively define a plurality of variable-volume chambers expanding and contracting in response to reciprocation of said plunger members;

a swash plate member pivotally carried by said housing within said cavity and variably angularly disposed relative to a transverse radial plane, each one of said plurality of plunger members engaging with said swash plate member for reciprocation in the respective one of said plurality of bores in response to rotation of said shaft;

said housing defining a pair of fluid inlet/return ports each for respectively receiving or discharging hydraulic fluid dependent upon direction of rotation of said shaft;

fluid flow communicating means communicating said plurality of variable-volume chambers with one of said pair of inlet/return ports during contraction of said chambers and with the other of said pair of inlet/return ports during expansion of said chambers with shaft rotation in one direction, shaft rotation in the opposite direction reversing the sense of said expansion or contraction of said plurality of chambers relative to said pair of ports;

resilient means yieldably urging said swash plate member to a first low displacement position whereat volume change of said plurality of variable-volume chambers is of lesser value, a pair of bores opening to said cavity;

a pair of pressure responsive piston members respectively received in said pair of bores and cooperatively associating with said swash plate member to urge the latter individually in opposite pivotal directions respectively in response to fluid pressure applied thereto;

flow path means communicating each of said pair of inlet/return ports with each of said pair of pressure responsive piston members;

bistable valve means interposing in said flow path means in a first position communicating one of said pair of ports with one of said pressure responsive piston members and communicating the other of said pair of pressure responsive piston members, and in a second position communicating said one port with the other piston member and said other port with said one piston member, said valve means shifting between said first and said second positions in response to fluid pressure differential between said pair of ports to communicate the lower fluid pressure to the first of said pair of pressure responsive piston members assisting said resilient means and the higher fluid pressure to the second of said pair of pressure responsive piston members, pressure differential responsive metering valve means for interposing in said flow path means between said bistable valve means and said second pressure responsive piston member, and said metering valve means communicating with said pair of ports and closing said communication so long as said pressure differential is below a certain value, at and above said certain value said metering valve means progressively metering fluid flow to said second pressure responsive piston member as a function of said pressure differential.

18. The invention of claim 17 wherein said bistable valve means includes said housing member defining an elongate closed bore, said flow path means communicating said pair of inlet/return ports individually with respectively opposite ends of said closed bore, an elongate pressure responsive spool valve member slidably and sealingly received in said closed bore for movement between said first position and said second position, said flow path means further including a respective pair of axially spaced apart ports opening on said closed bore intermediate the ends thereof and individually communicating with said pair of pressure responsive piston members, said spool valve member defining passage means therein for in each of said first and second position thereof communicating said pair of ports with respective ones of the opposite ends of said bore.

19. The invention of claim 18 wherein said spool valve member includes a pair of opposite ends communicating respectively with said pair of opposite bore ends, and four land portions axially spaced apart to cooperatively define three axially spaced apart groove portions therebetween, said passage means including a first passage communicating the center one of said three groove portions with one end of said spool valve member, and a second passage communicating the other two groove portions with one another and with the other end of said spool valve member, the axial spacing of adjacent ones of said three groove portions matching the spacing of said pair of ports on said closed bore.

20. The invention of claim 17 wherein said metering valve means includes said housing defining a stepped bore including a smaller diameter portion and a larger diameter portion, and the smaller diameter bore portion defining a portion of said flow path means between said bistable valve means and said second piston member, a stepped pressure responsive valve member sealingly and movably received in both bore portions of said stepped bore, said valve member in a first position closing communication through said flow path, a passage communicating the larger diameter portion of said stepped bore with said first pressure responsive piston member and said lower fluid pressure there at, means resiliently biasing said valve member yieldably to said first position, said stepped valve member moving to a second position in opposition to said resilient means in response to a certain fluid pressure differential between said smaller diameter bore portion and said lower fluid pressure communicating with said larger diameter bore portion to open communication through said flow path via said smaller diameter bore portion.

* * * * *